US007363217B2

(12) United States Patent
Lu et al.

(10) Patent No.: US 7,363,217 B2
(45) Date of Patent: Apr. 22, 2008

(54) METHOD FOR ANALYZING ENERGY CONSISTENCY TO PROCESS DATA

(75) Inventors: Yan-Chen Lu, Taipei Hsien (TW); Cheng-Ching Huang, Taipei Hsien (TW)

(73) Assignee: Vivotek, Inc. (TW)

( * ) Notice: Subject to any disclaimer, the term of this patent is extended or adjusted under 35 U.S.C. 154(b) by 776 days.

(21) Appl. No.: 10/926,957

(22) Filed: Aug. 27, 2004

(65) Prior Publication Data

US 2005/0228839 A1 Oct. 13, 2005

(30) Foreign Application Priority Data

Apr. 12, 2004 (TW) ..... 93110131 A

(51) Int. Cl.
*G10L 21/00* (2006.01)

(52) U.S. Cl. ..... 704/219; 704/220

(58) Field of Classification Search ..... 704/219, 704/220

See application file for complete search history.

(56) References Cited

U.S. PATENT DOCUMENTS

| | | | | |
|---|---|---|---|---|
| 5,226,084 | A * | 7/1993 | Hardwick et al. | 704/219 |
| 5,299,239 | A | 3/1994 | Iwahashi et al. | |
| 5,451,954 | A | 9/1995 | Davis et al. | |
| 5,890,108 | A * | 3/1999 | Yeldener | 704/208 |
| 2005/0165611 | A1 * | 7/2005 | Mehrotra et al. | 704/500 |

OTHER PUBLICATIONS

ISO/IEC 13818-7 "Information Technology—Generic Coding of Moving Pictures and Associated Audio, Part 7: Advanced Audio Coding", Notice p. 173.

M.J. Smithers et al., "Increased Efficiency MPEG-2 AAC Encoding", Notice p. 2.

2.ATSC A/52, "ATSC Digital Audio Compression Standard (AC-3)".

* cited by examiner

*Primary Examiner*—Daniel Abebe

(74) *Attorney, Agent, or Firm*—Lowe Hauptman Ham & Berner, LLP

(57) ABSTRACT

A method for analyzing energy consistency to process data, for use with an electronic apparatus, includes the steps of analyzing energy consistency to process data, performing a data-buffering process for outputting a data frame, performing a data-processing process for outputting a shaping residual after inputting the data frame, performing an energy-framing process for dividing the shaping residual into N sub-blocks after inputting the shaping residual to calculate energy of N sub-blocks to get a plurality of energy coefficients, performing a consistency-checking process for inputting the energy coefficients to check whether the energy coefficients can fulfill a threshold screening for consistency, enerating the decision about the data frame which should be processed by the long-type window coding if the spectral characteristics are consistent wherein the energy coefficients conform to the consistent energy relationship, and generating the decision about the data frame should be processed by the short-type window coding if the spectral characteristics are inconsistent wherein the energy coefficients can not conform to the consistent energy relationship.

17 Claims, 5 Drawing Sheets

METHOD FOR ANALYZING ENERGY CONSISTENCY TO PROCESS DATA

BACKGROUND OF THE INVENTION

1. Field of Invention

This invention related generally to an improvement of audio coding method, and more particularly, to a method for analyzing the consistency of signal energy to determine the time to perform block switching for better audio compression efficiency.

2. Description of Related Art

Perceptual audio coding is widely used in every music box related product currently. One of the crucial technologies in perceptual audio coding is the reduction of pre-echo phenomena. The solution in prior art is to divide a frame of signals into several blocks, and then choose long-type window coding or short-type window coding according to characteristics among these blocks. The characteristic is, the corresponding frame is more suitable for long-type window coding for increasing coding compression ratio when audio signal is stationary. FIG. 1 is a block diagram illustrating the conventional perceptual audio coding. The block diagram of FIG. 1 is well known to the art, thus related descriptions are omitted herein.

Conventionally, there are many different schemes to determine the suitable type for each frame. These documents related to block switching are listed as follows:

1. U.S. Pat. No. 5,299,239 (SONY 1994), which calculates energy of signals in different time intervals and performs block switching if the difference between two energies exceeds a specific constant. This method is too simple to find a correct timing to do block switching. The easy-changing characteristics of audio signal requires more complex algorithm to guarantee an appropriate tracking.

2. ISO/IEC 13818-7, "Information Technology-Generic Coding of Moving Pictures and Associated Audio, Part 7: Advanced Audio Coding", which determines the time of block switching by calculating perceptual entropy in psychoacoustic analysis. This method requires too much computation power and highly depends on the accuracy of psychoacoustic analysis.

3. ATSC A/52 "ATSC Digital Audio Compression Standard (AC-3)", which divides a large-scale signal output by a high-passing filter into several small-scale data frames. It then locates the maximum of sample values in each data frame and compares those maximum values. The block switching is activated if the difference of maximum values among the neighboring data frames exceeds some specific constants. Nevertheless, this method is too poor to resist the interference of noise, thus its accuracy is not stable.

4. M. J. Smithers et al., "Increased Efficiency MPEG-2 AAC Encoding", which is similar to the above method 3, but the high-passing filter coefficients and segmentation resolution are adjusted adaptively according to the sampling frequency.

5. U.S. Pat. No. 5,451,954 (DOLBY 1995), which is also similar to the above method 3, but the high-passing filter is replaced by a band-passing one. Besides, the average of the largest three samples in the data frame is selected to replace the maximum sample in the method 3 for further comparison between neighboring data frames.

As noted, the above mentioned methods 3, 4 and 5 can not handle noise interference well. The poor interference resistance by merely adopting single filter and constant threshold to trigger the block switching mechanism makes those methods insufficiently to deal with the instationary characteristics of audio signal.

Furthermore, the above method 2 uses an exhausted method to seek the best choice for block switching, i.e. executing every possible block switching decision to evaluate their effectiveness. The whole mechanism is computation-intensive and raising the hardware cost to an unbearable degree without any acceptable quality guarantee.

As mentioned above, the prior arts decide when to do block switching mainly by identifying the existence of transient data. That is, mainly depends on locating the energy maximum in blocks to decide to do block switching or not. Nevertheless, because of the in-stationary characteristic of audio signal, it's deficient to use the local energy maximum in blocks as a judgment to do block switching. Besides, an abrupt change of energy cannot explain all the happening of smearing effect. Any prior art whose principle is analyzing the transient nature of signal may suffer the inefficient ability to do block switching.

We can conclude from all these disadvantages mentioned above that the prior arts are no competitive in application. They have many difficulties in applying to practical commerce. Cost of practice is too high and can not reach an agreeable compromise with performance.

SUMMARY OF THE INVENTION

To solve the above problems, the purpose of this invention is to provide a method for analyzing energy consistency to process data. This invention divides signals into blocks and analyzes consistency of signal energy between those blocks to determine the right time for block switching.

To reach the above and other purposes, this invention provides a method for analyzing energy consistency to process data. This method includes the steps of carrying out a data-buffering process to output a data frame, carrying out a data-processing process which outputs a shaping residual after inputting the data frame, then carrying out an energy-framing process which divides the shaping residual into N sub-blocks after inputting the shaping residual to calculate energy values of these N sub-blocks so as to get a set of coefficients in respect of sub-blocks. N is an integer.

Afterward, the method further includes the steps of carrying out a consistency-checking process, which inputs energy coefficients of these sub-blocks to have a check to see if they conform to a pre-defined relationship or not. Processing the data frame by the long-type window coding if energy coefficients of these sub-blocks are consistent, whereby energy coefficients of these sub-blocks conform to the above pre-defined relationship, Contrarily, processing the data frame by the short-type window coding if energy coefficients of these sub-blocks are inconsistent, whereby the energy coefficients of these sub-blocks do not conform to the above pre-defined relationship.

In one embodiment of the present invention, the above data-buffering process processes the input frame in several different ways to output one data frame according to the compression schemes. This input data frame is a pulse code modulation (PCM) signal.

In one embodiment of the present invention, the above data-processing process includes the steps of inputting this data frame into a high-passing filter, then outputting a high-passing filter residual data, afterward, carrying out a center-clipping process, which inputs the high-passing filter residual and outputs the shaping residual through a center-clipping equation.

In one embodiment of the present invention, the above data-processing process further includes carrying out an adaptability control, which inputs the data frame and the corresponding shaping residual, and outputs the first difference characteristic value according to an energy-difference equation.

In one embodiment of the present invention, the above data-processing process further includes carrying out an adaptability control, which inputs the data frame and the corresponding high-passing filter residual, and outputs the second difference characteristic value according to an energy-difference equation.

In one embodiment of the present invention, the above data-processing process further includes carrying out an adaptability control, which inputs the shaping residual and the high-passing filter residual, and outputs the third difference characteristic value according to an energy difference equation.

In one embodiment of the present invention, the above method further includes respectively summing up energy of the shaping residuals in each sub-block to calculate corresponding sub-block's energy coefficient.

In one embodiment of the present invention, the above energy-framing process additionally includes, from the energy coefficients of these N sub-blocks, retrieving the average of the greater M ones as a maximum energy average, besides, from energy coefficients in these N sub-blocks, retrieving the average of the less P ones as a minimum energy average. Then, a first energy ratio is generated by dividing maximum energy average with the minimum energy average. If the first energy ratio is smaller than a critical difference value, the data frame is judged to conform to a consistent energy relationship.

In one embodiment of the present invention, the above energy-framing process further includes, from the energy coefficients of these N sub-blocks, searching out the maximum energy coefficient and the minimal energy value. Afterward, second energy ratio is generated by dividing the maximum energy coefficient with the minimum one. Then, if the second energy ratio is smaller than a critical difference value, so the data frame is judged to conform to a consistent energy relationship.

In conclusion, this invention provides a method for analyzing energy consistency to process data. This method decides the time to do block switching by analyzing consistency of block energy. So, this method overcomes the disadvantage using some constant values to operate with the relative maximum energy value as a judgment to do block switching and doesn't consume much power. By using this method to process audio signals, we can easily control the instationary of audio signals and precisely choose the correct timing to do block switching.

DETAILED DESCRIPTION OF THE PREFERRED EMBODIMENTS

Figure 1:
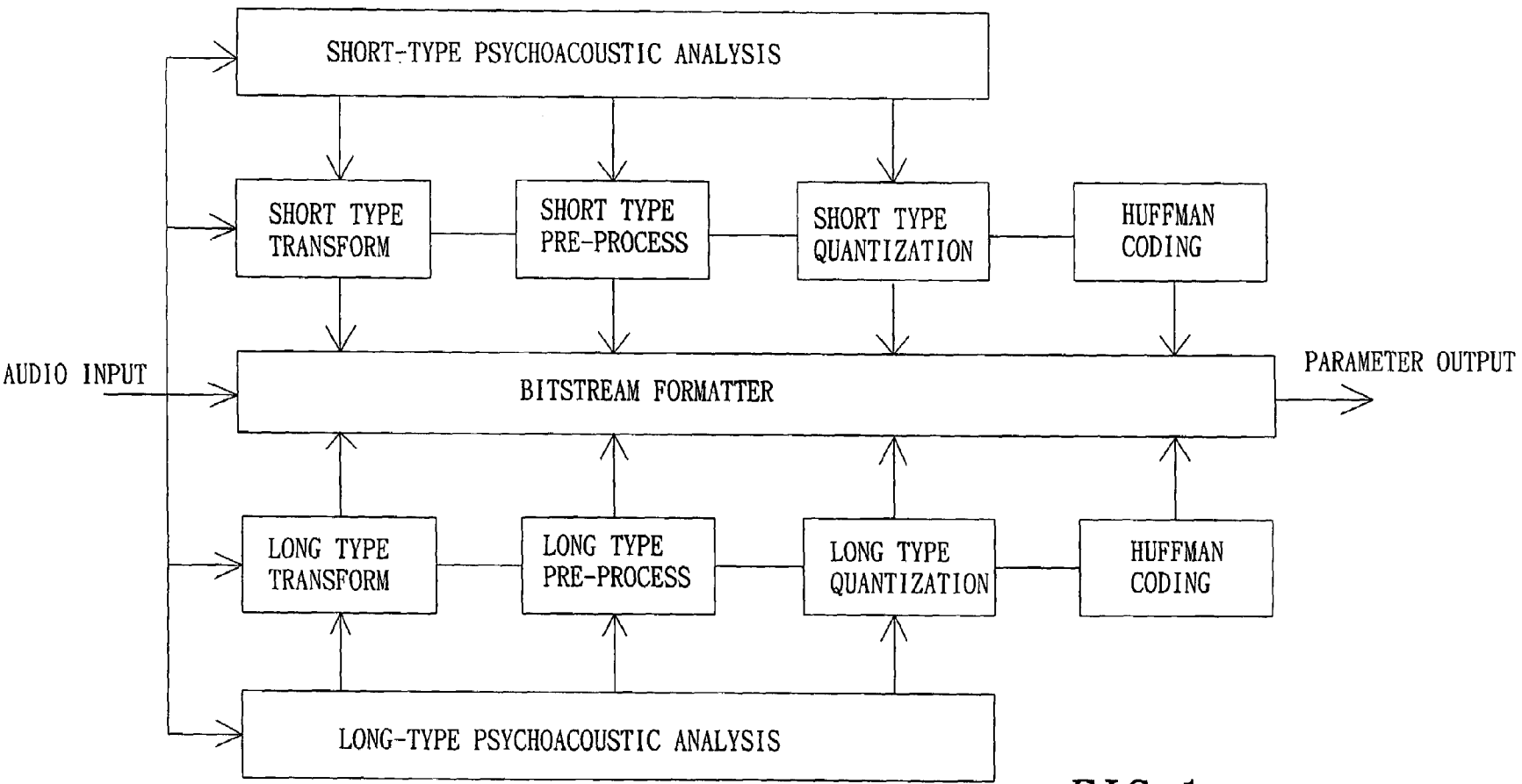
FIG. 1 is a block diagram illustrating the prior art perceptual audio coding.
Figure 2:
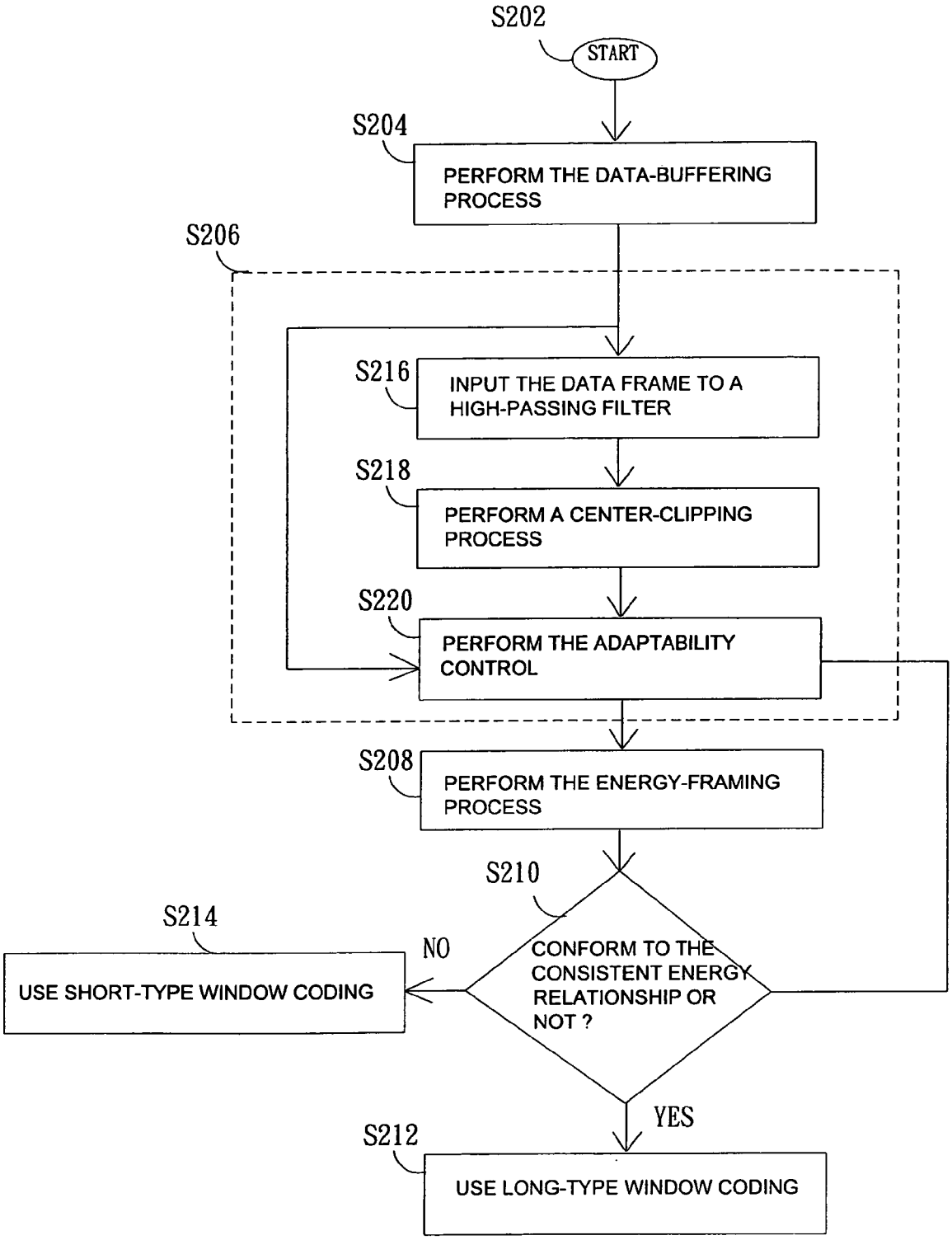
FIG. 2 illustrates a flowchart of the method for analyzing energy consistency to process data according to one embodiment of this invention.

Refer to FIG. 2 that illustrates a flowchart of this invention of analyzing energy consistency data process. This method first carries out the data-buffering process to output a data frame. That is, this method is based on different compression schemes to process corresponding input data with different size (S204). Then, the method performs a data-processing process, which outputs a shaping residual after inputting the data frame (S206). The method performs an energy-framing process, which divides the shaping residual into N sub-blocks after inputting the shaping residual. It then calculates energy values of these N sub-blocks so as to get a set of coefficients in respect of sub-blocks. N is an integer (S208).

Subsequently, this method performs the consistency-checking process. This consistency-checking process inputs the above sub-block energy coefficients to check if these sub-block energy coefficients are conforming to a consistent energy relationship or not (S210). Then, if these sub-block energy coefficients conform to the consistent energy relationship, energy in these sub-blocks is consistent. So, this method concludes that this data frame is capable of have a better performance with long-type window coding process (S212). Contrarily, if these sub-block energy coefficients do not conform to the consistent energy relationship, energy in these sub-blocks is inconsistent. So, this method concludes that the above data frame is capable of have a better performance with short-type window coding process (S214).

As mentioned above, the data-processing process inputs the data frame into a high-passing filter, and then outputs a high-passing filter residual data. That is, the data-processing process inputs the data frame to a high-passing filter to remove the low-frequency component so as to output a high-passing filter residual (S216). Afterward, the process performs a center-clipping process, which inputs the high-passing filter residual and then outputs the shaping residual through a center-clipping equation (S218). Then, the data-processing process performs an adaptability control, which inputs the data frame and the corresponding shaping residual so as to output the first difference characteristic value according to an energy-difference equation (S220).

The following explains the above energy-framing process and the above consistent energy relationship. The energy-framing process, from the above N sub-block's energy coefficients, retrieves the average of the greater M ones as a maximum energy average. Therein, M is an integer, $M<N$. Then, the energy-framing process, from these N sub-block's energy coefficients, retrieves the average of the less P ones as a minimum energy average where P is an integer and $P<N$. Afterward, the energy-framing process divides the maximum energy average with the minimum energy average to generate the first energy ratio. If the first energy ratio is smaller than a critical difference value, the data frame conforms to a consistent energy relationship.

Besides, there is the other way to acquire the above consistent energy relationship discrimination. The energy data frame, from the above N sub-block's energy coefficients, acquires a maximum energy value. And, the energy-framing process, from these N sub-block's energy coefficients, acquires a minimum energy value. Then, according to the energy-framing process, the maximum energy value is divided by the minimum energy value to generate the second energy ratio. If the second energy ratio is smaller than a critical difference value, the data frame conforms to a consistent energy relationship.

The following explains this method by instances. The method processes one data frame at a time and processes the data frame with long-type window coding or short-type window coding to prevent quality degradation. This method first performs the data-buffering process. This method, according to the compression schemes, buffers different sizes of time-domain signal to get a data frame; this current output data frame contains the kind of pulse code modulation signals. In this embodiment, the data frame is the pulse code modulation signal; capacity of this data frame is at the multiple of 64 words. For example, if the compression scheme is MPEG-1 Layer-3, under 16-bit pulse code modulation sampling, the size of data frame is 2304 words. If the compression scheme is MPEG-2/2.5 Layer-3, under 16-bit pulse code modulation sampling, the size of data frame is 1152 words. If the compression scheme is MPEG-2/4 AAC, under 16-bit pulse code modulation sampling, the size of data frame is 2048 words. If the compression scheme is MPEG4 LD AAC, under 16-bit pulse code modulation sampling, the size of data frame is 1920 words. If the compression scheme is Dolby AC-3, under 16-bit pulse code modulation sampling, the size of data frame is 1024 words. The data frame is queued in a buffering memory (not shown) for further process; space of the buffering memory in this embodiment is the double size of data frame. Similarly, the processed data is the double size of data frame as at any process is performed hereafter.

Then, this method performs the data-processing process. The data-processing process inputs the data frame to a high-passing filter to remove the low-frequency component and output a high-passing filter residual. In this embodiment, this high-passing filter is a 7-tap non-causal type-1 finite impulse response filter designed via Kaiser window method, its mathematical equation is listed as follows:

$$y(n) = \sum_{k=0}^{6} a_k x(n-k-3),\ n = 0, 1, \ldots, framelength - 1.$$

The designer can place the cut-off frequency at $\pi/2$ to obtain a half-band high-passing filter. Non-causal manner can prevent filtering latency, thus this high-passing filter can obtain a better-synchronized data.

Afterward, the data-processing process performs a center-clipping process. That is, the center-clipping process manipulates the above high-passing filter residual with the following center-clipping equation to output a shaping residual. The center-clipping equation is:

$$y = clc(x) = \begin{cases} x + CL;\ x \le -CL \\ x - CL;\ x \ge CL \\ 0;\ -CL < x < CL \end{cases},$$

where x is the high-passing filter residual, y is the shaping residual, and CL is a threshold in real number. Through the process of this equation, the small fluctuation of waveform and the DC big spike in the high-passing filter residual are reduced or removed which means the values of high-passing filter residual decrease nonlinearly. CL can be calculated as following:

$$CL = C1 - D1 \times W1,$$

where C1 and W1 are experimental coefficients and D1 is the first difference characteristic value inherited from the process of the last data frame.

Afterward, the data-processing process carries out adaptability control. Adaptability control inputs the above data frame and the above shaping residual into an energy difference equation, and then outputs the first difference characteristic value. This energy difference equation is:

$$D = \sum_i (A(i) - B(i))^2,$$

where i is an integer, A(i) is the data frame, B(i) is the shaping residual, and D is the first difference characteristic value.

Then, this method carries out the energy-framing process. This energy-framing process inputs the above shaping residual to do framing and energy calculation. According to the compression schemes, it divides the shaping residual into N sub-blocks where N is an integer. For example, if the compression scheme is MPEG-1 Layer-3, where N equals to 3. That is, the sub-block is 768 words. If the compression scheme is MPEG-2/2.5 Layer-3, where N equals to 3. That is, the sub-block is 384 words. If the compression scheme is MPEG-2/4 AAC, where N equals to 8. That is, the sub-block is 256 words. If the compression scheme is MPEG-4 LD AAC, where N equals to 4. That is, the sub-block is 480 words. If the compression scheme is Dolby AC-3, where N equals to 4. That is, the sub-block is 256 words.

Then, this energy-framing process calculates energy of the above N sub-blocks to get the energy coefficients by respectively summing up the energy of corresponding shaping residuals in N sub-blocks.

Afterward, this method carries out consistency-checking process; the checking purpose is to signify the differential degree among sub-block energy coefficients, not the differential quantity exists between these coefficients. This consistency-checking process inputs the above sub-block energy coefficients to check whether these sub-block energy coefficients conform to a consistent energy relationship or not. The consistent energy relationship can be represented as follows:

$$E1/E2 < \text{Threshold}$$

Noticeably, E1/E2 may be first energy ratio, which means the ratio is acquired by dividing maximum energy average E1 with minimum energy average E2. On the other hand, E1/E2 may be generated by the way of second energy ratio, which means the ratio is acquired by dividing maximum energy coefficient E1 with minimum energy coefficient E2. And, the critical difference value (Threshold) can be represented by the following mathematical equation:

$$\text{Threshold} = (C - \log(D)) \times W$$

where D is one of difference characteristic values described above. C and W are real numbers derived from trial and error.

Figure 3:
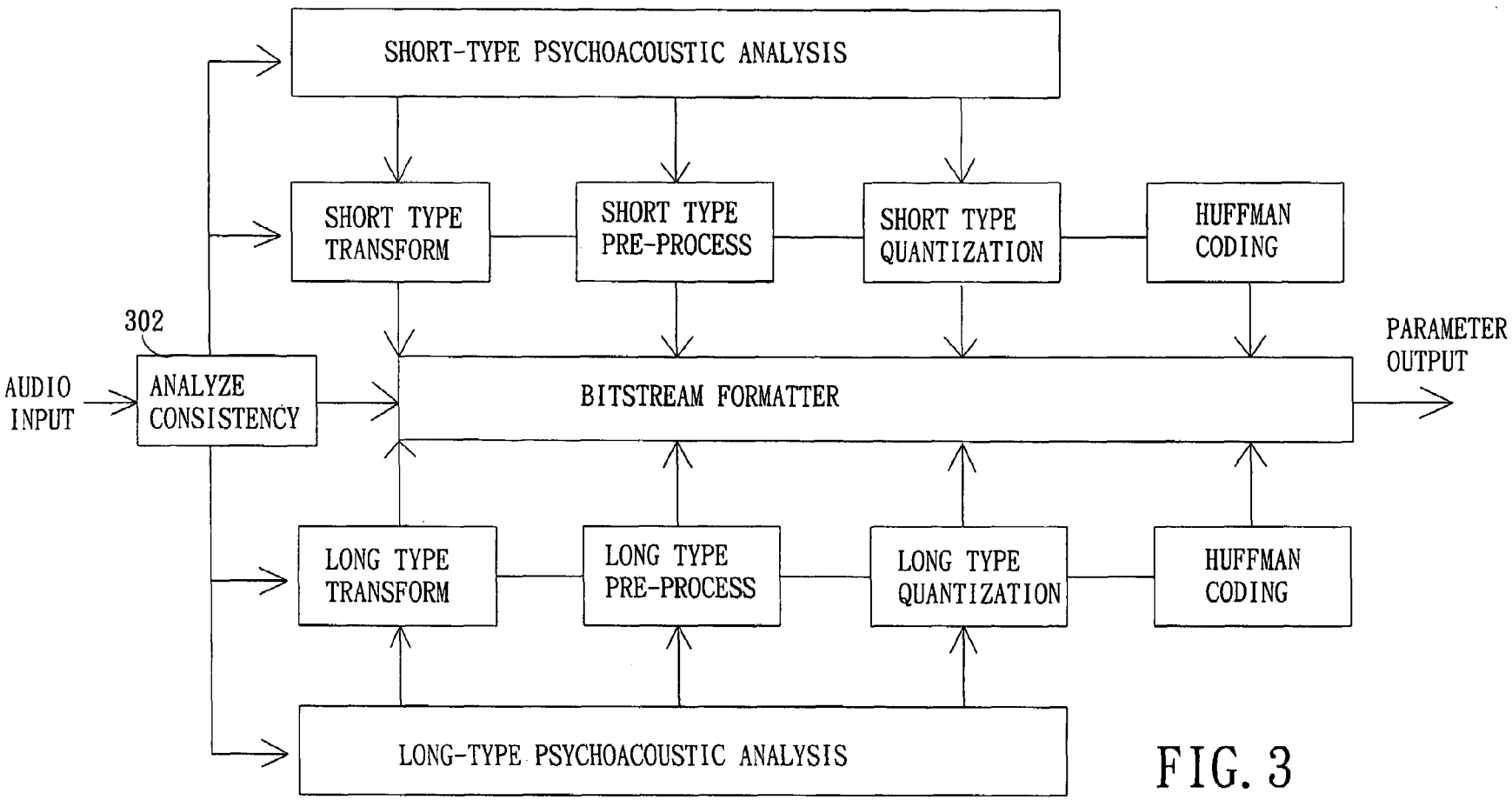
FIG. 3 illustrates a block diagram of the method for analyzing energy consistency to process data according to one embodiment of this invention.

If these sub-block energy coefficients conform to the above consistent energy relationship, energy among these sub-blocks is consistent. Therefore, this method concludes that the current data frame can acquire a better coding gain by the long-type window coding. Contrarily, if these sub-block energy coefficients don't conform to the above consistent energy relationship, energy among these sub-blocks is inconsistent. So, this method concludes that the current data frame can acquire a better coding gain by the short-type window coding. Refer to FIG. 3, it illustrates a block diagram of the method for analyzing energy consistency to process data. Therein, the block 302 is the method for analyzing energy consistency to process data. The time-domain audio signals are feed to the block 302, and block 302 will determine the compression mechanism, which is suitable for the input data. The long-type window coding and the short-type window coding are the prior art, without restating here again.

Figure 4:
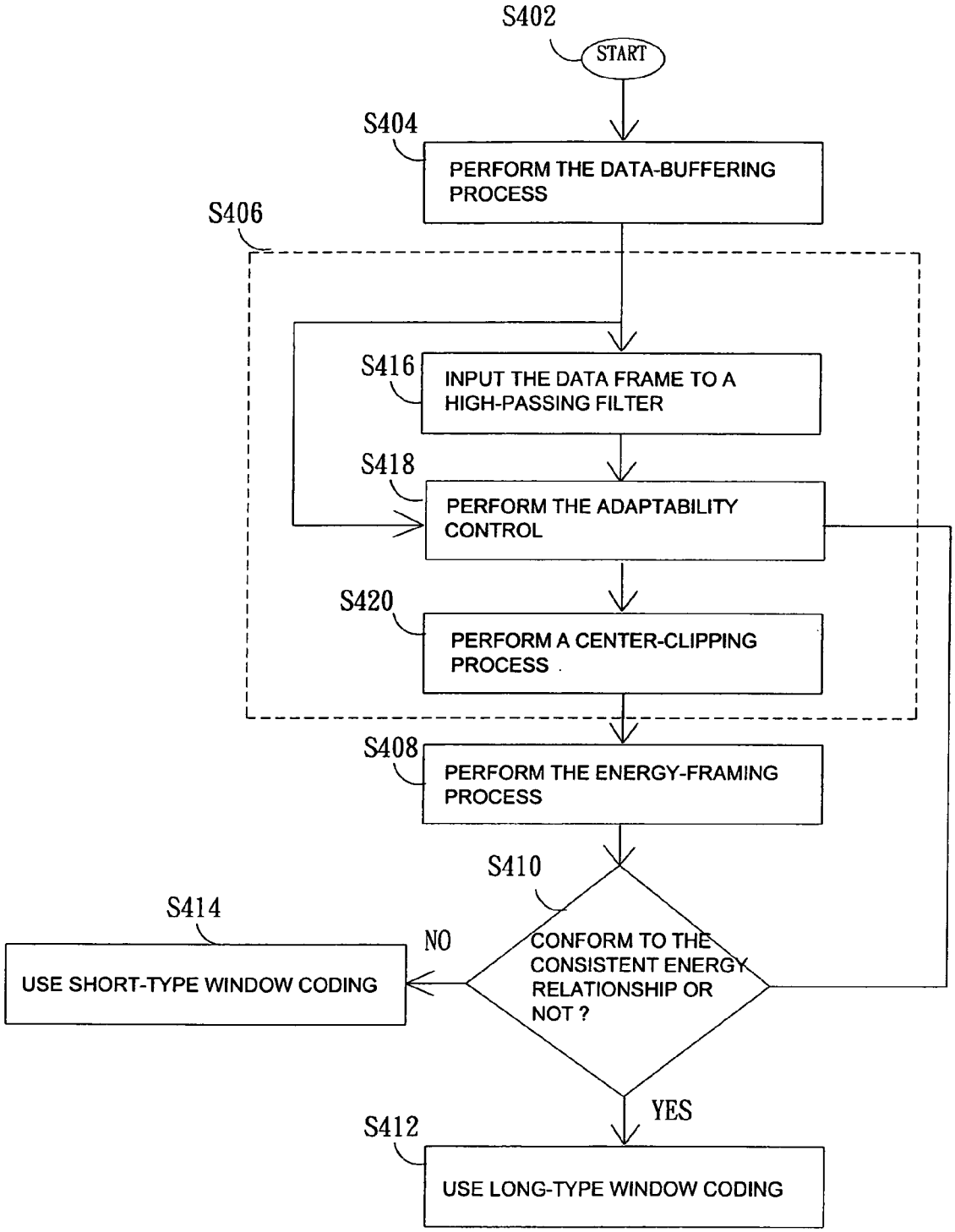
FIG. 4 illustrates a flowchart of the method for analyzing energy consistency to process data according to one embodiment of this invention.

Refer to FIG. 4 in conjunction with FIG. 2 for illustrating a flowchart, as one embodiment of the method for analyzing energy consistency to process data. Every step in this embodiment is similar to the embodiment of FIG. 2. The difference is, the data-processing process includes the following steps: the data-processing process first inputs the data frame into a high-passing filter. That is, this high-passing filter removes the low-passing component of the data frame to output a high-passing filter residual (S416). Then, the data-processing process carries out an adaptability control. That is, input the data frame and high-passing residual, by an energy difference function process, to output the second difference characteristic value (S418). Afterward, the data-processing process carries out a center-clipping process. That is, the center-clipping process inputs the above high-passing filter residual, by a center-clipping equation process, to output the shaping residual (S420). Therein, the energy difference equation is:

$$D = \sum_i (A(i) - B(i))^2,$$

where i is an integer, A(i) is the data frame, B(i) is the high-passing filter residual, and D is the second difference characteristic value. Moreover, the energy difference equation and the second difference characteristic value use the similar method of FIG. 2 embodiment to perform the follow-up process. Finally, a decision is generated about the current data frame should be processed by the long-type window coding or short-type window coding process. The above detail is similar to FIG. 2 embodiment, without restating here again.

Figure 5:
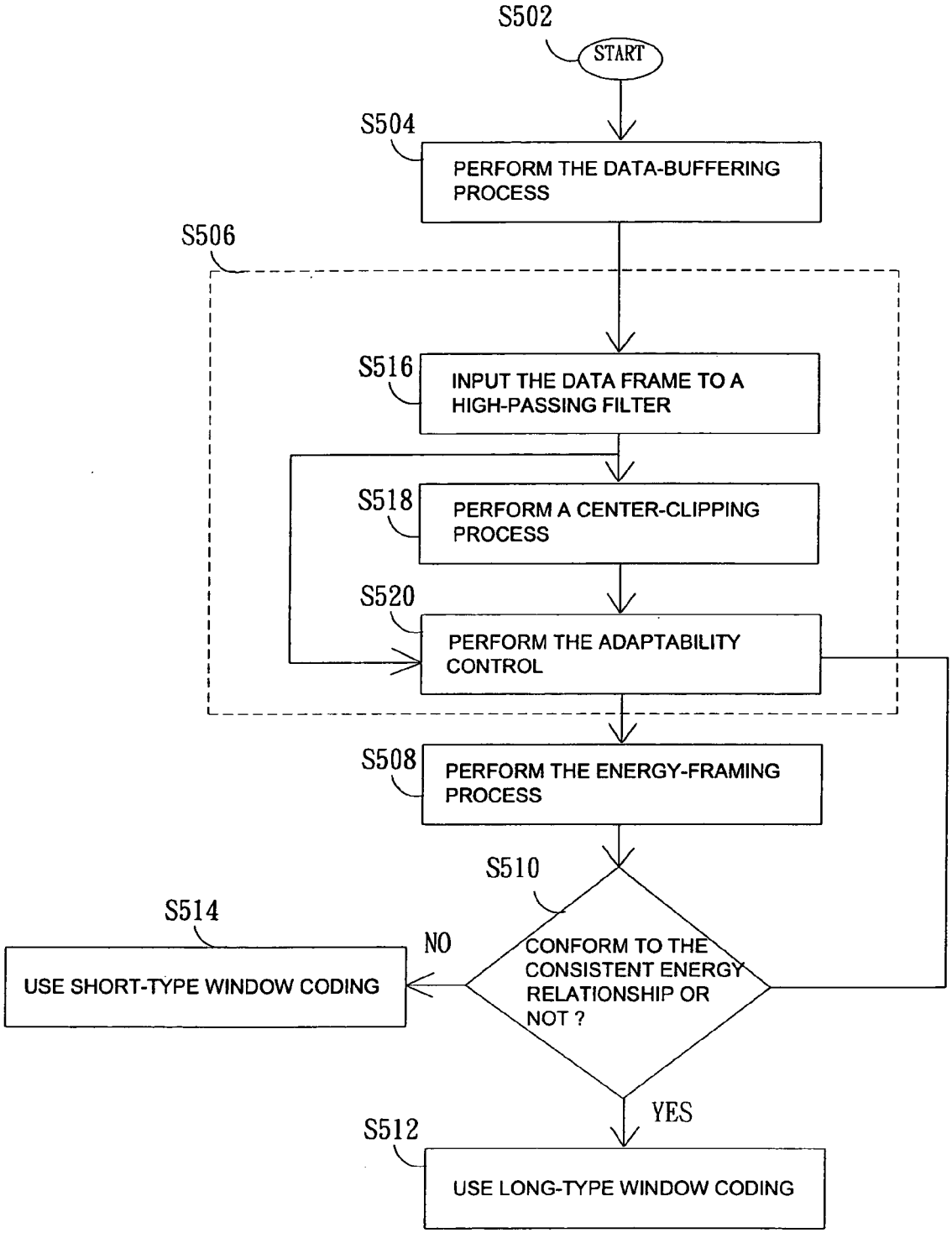
FIG. 5 illustrates a flowchart of the method for analyzing energy consistency to process data according to one embodiment of this invention.

Refer to FIG. 5 in conjunction with FIG. 2 for illustrating a flowchart, as one embodiment of the method for analyzing energy consistency to process data. Every step in this embodiment is similar to the embodiment of FIG. 2. The difference is, the data-processing process includes the following steps: the data-processing process first inputs the data frame to a high-passing filter. That is, this high-passing filter removes the low-frequency component of the data frame to output a high-passing filter residual (S516). Then, the data-processing process carries out a center-clipping process. That is, the center-clipping process inputs the above high-passing filter residual, by a center-clipping equation process, to output the shaping residual (S518). Afterward, the data-processing process carries out an adaptability control. That is, input shaping residual and high-passing residual, by an energy difference equation process, to output the third difference characteristic value (S520). The energy difference equation is:

$$D = \sum_i (A(i) - B(i))^2,$$

where i is an integer, A(i) is the high-passing filter residual, B(i) is the shaping residual and D is the third difference characteristic value. Moreover, this energy difference equation and the third difference characteristic value use the similar method of FIG. 2 embodiment to perform the follow-up process. Finally, a decision is generated about the current data frame should be processed by the long-type window coding or the short-type window coding. The above detail is similar to FIG. 2 embodiment, without restating here again.

Here especially explaining, the mathematical forms of the center-clipping equation, energy difference equation and the critical difference value in this invention aren't immutable. The skilled in the art can adjust the method of practice depending on circumstances.

In conclusion, this invention provides a method for analyzing energy consistency to process data. This method emphasizes on analyzing energy consistency among blocks, not locating the energy maximum in blocks. Therefore, it can significantly simplify the process of block-switching decision and improve its resistance to interference noise. By applying this method to generate block switching decision, the product's competitiveness can be upgraded in respects of both cost and quality.

While the invention herein disclosed has been described by means of specific embodiments, numerous modifications and variations could be made thereto by those skilled in the art without departing from the scope and spirit of the invention set forth in the claims.

What is claimed is:

1. A method for analyzing energy consistency to process data, comprising:

performing a data-buffering process for outputting a data frame;

performing a data-processing process for outputting a shaping residual after inputting said data frame;

performing an energy-framing process for dividing said shaping residual into N sub-blocks after inputting said shaping residual to calculate energy of N sub-blocks to get a plurality of energy coefficients, wherein N is an integer;

performing a consistency-checking process for inputting said energy coefficients to check whether said energy coefficients conform to a consistent energy relationship or not;

generating the decision about said data frame should be processed by the long-type window coding if said energy coefficients are consistent wherein said energy coefficients conform to said consistent energy relationship; and, generating the decision about said data frame should be processed by the short-type window coding if said energy coefficients are inconsistent wherein said energy values can not conform to said consistent energy relationship.

2. The method of claim 1, wherein said data-buffering process comprises:

buffering said data frame to output said data frame with different size according to a corresponding compression scheme.

3. The method of claim 1, wherein said data frame is a pulse code modulation signal.

4. The method of claim 1, wherein the size of said data frame is a multiple of 64 words.

5. The method of claim 1, wherein said data-processing process comprises:

inputting said data frame into a high-passing filter to output a high-passing filter residual; and, performing a center-clipping process for inputting said high-passing filter residual and outputting said shaping residual according to a center-clipping equation.

6. The method of claim 5, wherein said center-clipping equation is:

$$y = clc(x) = \begin{cases} x + CL; x \le -CL \\ x - CL; x \ge CL \\ 0; -CL < x < CL \end{cases},$$

where x is said high-passing filter residual, y is said shaping residual, and CL is a real number.

7. The method of claim 1, wherein said data-processing process comprises:

performing an adaptability control for inputting said data frame and said corresponding shaping residual, and outputting a first difference characteristic value according to an energy-difference equation.

8. The method of claim 7, wherein said energy-difference equation is:

$$D = \sum_i (A(i) - B(i))^2,$$

where i is an integer, A(i) is said data frame, B(i) is said shaping residual, and D is said first difference characteristic value.

9. The method of claim 1, wherein said data-processing process comprises:

performing an adaptability control for inputting said data frame and said corresponding high-passing filter residual, and outputting a second difference characteristic value according to an energy-difference equation.

10. The method of claim 9, wherein said energy-difference equation is:

$$D = \sum_i (A(i) - B(i))^2,$$

where i is an integer, A(i) is said data frame, B(i) is said high-passing filter residual, and D is said second difference characteristic value.

11. The method of claim 1, wherein said data-processing process comprises:

performing an adaptability control for inputting said shaping residual and said high-passing filter residual, and outputting a third difference characteristic value according to an energy difference equation.

12. The method of claim 11, wherein said energy-difference equation is:

$$D = \sum_i (A(i) - B(i))^2,$$

where i is an integer, A(i) is said high-passing filter residual, B(i) is said shaping residual, and D is said third difference characteristic value.

13. The method of claim 1, further comprising:

summing up energy of said shaping residuals respectively in said N sub-blocks to get energy coefficients corresponding to said sub-blocks.

14. The method of claim 1, wherein said energy-framing process comprises:

taking greater energy coefficients of M sub-blocks from a plurality of energy coefficients of said N sub-blocks in which said greater energy coefficients of M sub-blocks divided by N is a maximum energy average where M is an integer and M<N; and, taking less energy coefficients of P sub-blocks among a plurality of energy coefficients of said N sub-blocks in which said less energy coefficients of P sub-blocks divided by N is a minimum energy average where P is an integer, P<N, and said maximum energy average divided by said minimum energy average is a first energy ratio;

wherein if said first energy ratio is smaller than a critical difference value, the data frame conforms to a consistent energy relationship.

15. The method of claim 14, wherein said critical difference value corresponds:

$$\text{Threshold}=(C-\log(D))\times W,$$

Where D is one of a first difference characteristic value, a second difference characteristic value and a third difference characteristic value, C and W are real numbers.

16. The method of claim 1, wherein said energy-framing process further comprises:

taking a maximum energy coefficient and a minimal energy value from the energy coefficients of these N sub-blocks in which said maximum energy coefficient divided by said minimum energy coefficient is a second energy value;

wherein if said second energy value is smaller than a critical difference value, said data frame conforms to said consistent energy relationship.

17. The method of claim 16, wherein said critical difference value corresponds:

$$\text{Threshold}=(C-\log(D))\times W,$$

where D is one of a first difference characteristic value, and a second difference characteristic value and a third difference characteristic value, C and W are real numbers.

* * * * *